US007992595B2

(12) United States Patent
Debaes et al.

(10) Patent No.: US 7,992,595 B2
(45) Date of Patent: Aug. 9, 2011

(54) WOVEN ARTIFICIAL GRASS MAT HAVING A FINE PILE DISTRIBUTION

(75) Inventors: Johny Debaes, Moorslede (BE); Marc Delepierre, Zingem (BE)

(73) Assignee: N.V. Michel Van de Wiele, Kortrijk Marke (BE)

( * ) Notice: Subject to any disclaimer, the term of this patent is extended or adjusted under 35 U.S.C. 154(b) by 0 days.

(21) Appl. No.: 12/450,900

(22) PCT Filed: Apr. 15, 2008

(86) PCT No.: PCT/EP2008/002986

§ 371 (c)(1), (2), (4) Date: Nov. 12, 2009

(87) PCT Pub. No.: WO2008/128677

PCT Pub. Date: Oct. 30, 2008

(65) Prior Publication Data

US 2010/0092701 A1 Apr. 15, 2010

(30) Foreign Application Priority Data

Apr. 18, 2007 (BE) ..... 2007/0188

(51) Int. Cl.

| | |
|---|---|
| ***D03D 39/00*** | (2006.01) |
| ***D03D 39/10*** | (2006.01) |
| ***D03D 27/06*** | (2006.01) |
| *D03D 25/00* | (2006.01) |

(52) U.S. Cl. ..... 139/21; 139/37; 139/391; 139/102; 139/116.5

(58) Field of Classification Search ..... None
See application file for complete search history.

(56) References Cited

U.S. PATENT DOCUMENTS

| | | | | |
|---|---|---|---|---|
| 4,230,752 | A * | 10/1980 | Benedyk | 428/17 |
| 4,426,415 | A * | 1/1984 | Avery | 428/17 |
| 5,398,730 | A * | 3/1995 | Derudder et al. | 139/21 |
| 6,817,383 | B2 * | 11/2004 | Debaes et al. | 139/21 |
| 6,837,274 | B2 * | 1/2005 | Debaes et al. | 139/21 |
| 7,240,698 | B2 * | 7/2007 | Debaes | 139/37 |
| 7,287,552 | B2 * | 10/2007 | Debaes et al. | 139/21 |
| 2003/0226613 | A1 * | 12/2003 | Debaes et al. | 139/408 |
| 2004/0142758 | A1 * | 7/2004 | Shioda | 473/278 |
| 2004/0221915 | A1 * | 11/2004 | Debaes et al. | 139/409 |
| 2006/0107880 | A1 * | 5/2006 | Peeples | 112/80.41 |
| 2006/0118196 | A1 * | 6/2006 | Debaes | 139/11 |
| 2006/0137758 | A1 * | 6/2006 | Debaes et al. | 139/11 |
| 2007/0006932 | A1 * | 1/2007 | Mertens et al. | 139/37 |
| 2007/0237921 | A1 * | 10/2007 | Knapp et al. | 428/92 |
| 2008/0141516 | A1 * | 6/2008 | Julicher et al. | 29/419.1 |
| 2008/0145574 | A1 * | 6/2008 | Julicher et al. | 428/17 |
| 2009/0050037 | A1 * | 2/2009 | Hall et al. | 112/80.32 |

FOREIGN PATENT DOCUMENTS

JP 2003-129409 8/2003

(Continued)

*Primary Examiner* — Bobby H Muromoto, Jr.
(74) *Attorney, Agent, or Firm* — James Creighton Wray

(57) ABSTRACT

An artificial grass mat that is composed of a ground fabric and a number of artificial grass blades protruding from the ground fabric, at least one of the artificial grass blades being formed from a pile-warp yarn (1-6; 7-10; 15-18) having a density of less than 5,000 dtex; and a method for producing an artificial mat of this type. The artificial grass mat is suitable both for use in athletics, such as football, tennis, hockey, golf, and for other uses, including domestic and garden applications, as a decorative landscape element.

14 Claims, 1 Drawing Sheet

FOREIGN PATENT DOCUMENTS

| | | |
|---|---|---|
| WO | WO 98/23817 | 6/1998 |
| WO | WO 2004/057111 | 7/2004 |
| WO | WO 2006/091085 | 8/2006 |
| WO | WO 2007/116290 | 10/2007 |

* cited by examiner

WOVEN ARTIFICIAL GRASS MAT HAVING A FINE PILE DISTRIBUTION

This application claims the benefit of Belgian Application No. 2007/0188 filed Apr. 18, 2007 and PCT/EP2008/002986 filed Apr. 15, 2008, which are hereby incorporated by reference in their entirety.

BACKGROUND OF THE INVENTION

The present invention relates, on the one hand, to an artificial grass mat comprising a ground fabric and a number of artificial grass blades protruding from the ground fabric. On the other hand, the present invention relates to a method for the production of an artificial grass mat of this type.

Artificial grass mats are increasingly being used to replace natural grass because:

- climate conditions are not always suitable for natural grass;
- loads which are imposed on natural grass (for example when practising sport) damage the ground, so lengthy intervals are necessary before the ground can be used again;
- natural grass is obviously high-maintenance.

It is generally known to produce artificial grass mats by connecting plastics material grass fibres to a support material, the plastics material grass blades protruding preferably perpendicularly from the supporting fabric. The plastics material grass blades are usually hard and smooth plastics material fibres such as polyolefins (polyethylene, polypropylene and blended forms) or polyamides.

Usually, the support material is a textile cloth through which the plastics material grass blades are tufted. In other words, a plastics material grass fibre is pressed through the cloth by means of a needle, thus forming a loop. On the other side of the textile cloth, a hook takes over the loop formed and brings this loop to the desired height. Subsequently, the loop is usually cut through, thus forming two upright grass blades. The support material can be woven, knitted or a nonwoven.

Instead of tufting the plastics material grass blades through the support material, they can also be produced as a pile in a pile fabric or pile knit.

However, in the production of textile cloths, the yarns, and in particular the pile yarns, are the most expensive part of the product. Solutions which yield the same performance levels while consuming fewer yarns are thus economically very beneficial solutions and solutions which yield higher performance levels while consuming the same number of yarns are industrially very beneficial solutions.

International patent application WO 2004/057111 describes the improvement to spread the artificial grass blades equally in the artificial turf mat during tufting by selecting the distance between the pile rows and the distance between piles in a single row so as to be approximately equal and, in addition, setting this distance to at least 10 mm. This is to prevent the studs on the boots of, for example, footballers from becoming caught in the pile yarns and also to be able easily to release the filling in order to prevent compression of the filling.

This means that merely a limited number of pile tufts have to be used: for 10 mm×10 mm, there are at most 10,000 pile tufts/m2 and in the preferred embodiment of 13 mm×13 mm, there are at most 5,900 pile tufts/m2; in a further preferred embodiment of 16 mm×16 mm, there are just 3,900 pile tufts/m2.

During the tufting of artificial grass, it is therefore known to use mainly relatively thick filaments in order to arrive at a good degree of pile occupation. For this purpose, mainly polyethylene and polypropylene yarns are used as fibrillated strip yarns or as bundled monofilaments having a fibre density of between 6,000 and 14,000 dtex, 10,000 to 14,000 dtex usually being used for football applications (density of 10,000 dtex=1,000 tex means that the fibre or the yarn has a weight of 1,000 g per km of length). That is to say, artificial grass should be used to create a state in which the density of the artificial grass blades has an attractive appearance and, for example for sport applications, the artificial grass blades can support a ball effectively.

A combination of tuft/burl density and the density of artificial grass blades which, in turn, usually consist of a number of relatively thin fibres or monofilaments which are bundled to form a plastics material yarn determines the behaviour of a ball rolling on an artificial grass mat.

Tuft densities are characterized by two parameters:

- the density of the tufting needles in the needle block. This parameter is expressed as the gauge having the following conventional values: ¾" or ⅝" for one needle per 19 mm and per 15.8 mm respectively or, put differently, 52 and 63 needles and thus tuft rows per metre respectively;
- the density of the stitches per length of unit characterizes the density in the other direction and is between 10 and 20 per 10 cm, usually 13 to 16 per cm, corresponding to: 100 to 200 pile tufts per metre and usually 130 to 160 pile tufts per metre (or, put differently, gaps between 10 and 5 mm and 8 and 6 mm respectively). Per $m^2$, this yields a number of pile tufts of between 5,200 and 12,600 and usually between 6,760 and 10,000 tufts/$m^2$.

It will be clear from the foregoing that the limitations, known in tufting practice, in the density of needles and in the limited density of artificial grass pile make it difficult to achieve the balance proposed in WO 2004/057111 between the number of tufts per metre in one direction and the number of tufts per metre in the other direction. That is to say, relatively high densities, both for the needles and for the stitches, present in these types of yarns a problem as a result of the heating of the needles in the tufting process. Pile tufts heavier than the specified 14,000 dtex also present a problem to the needles in the tufting process.

This limitation of tuft density and fibre density limits the possibilities of the further improvement to the properties of artificial grass using the tufting process.

The patent Applicant saved considerable amounts of raw materials by weaving artificial grass with 16,000-dtex pile yarns (bundle of 8 2,000-dtex filaments) in a 7/16 W weave structure. The patent Applicant thus achieved the advantage that each pile burl has two pile legs which are set apart from each other over 8 picks, and this usually amounts to ±16 mm from each other. As a result, the pile yarns (16,000 dtex) behave in a theoretically equivalent manner to tufted pile yarns having a density of 8,000 dtex but double in number, because the tufting process entails that the two pile legs are at all times directly next to each other.

However, practical experience teaches that both in terms of appearance and in terms of properties, a woven artificial grass mat comprising 5,000 pile burls (each having two pile legs) having a density of 16,000 dtex behaves at least as well as a tufted artificial grass mat comprising 8,400 12,000-dtex tuft burls (each having two tuft legs). The improved spread of the pile legs in the desired artificial grass mat thus yields a considerable advantage in terms of the saving of raw materials, in the aforementioned case 20%.

A drawback of both the weaving and the tufting of artificial grass using pile yarns having densities of 6,000 and higher is that during the replacement of bobbins the pile yarn of the new bobbin must be linked e.g. by knotting to the pile yarn of the old bobbin and that the linking of "thick" pile yarn strips or filament bundles of this type is difficult, time-consuming and labour-intensive. In addition, the knots have large dimensions and can thus cause manifold disturbances in the weaving or tufting process.

Furthermore, a knot in pile yarns like this, when jammed (for example as a result of a knot which becomes stuck) stop the machine only when the pile yarn breaks. In order to break through pile yarns of this type, a very high degree of force must be applied, as a result of which machine components or harness components, such as for example headles or bobbin spindles in the weaving creel, are often also sollicitated by high loads and undergo deformation or break. This causes additional problems, downtimes and intervention costs.

Furthermore, in order to achieve a high degree of autonomy of the weaving—or tufting machine, the bobbins comprising these highly thick pile yarns must be suitably heavy to be able to produce a considerable fabric length before replacing the bobbin. This makes it more difficult to carry out the supply of the yarns in the weaving creel.

The object of the invention is to find an artificial grass mat and a method for the production of a woven artificial grass mat in which the pile yarn is distributed more uniformly over the artificial grass mat and preferably yields material saving (especially in pile yarns) while at the same time maintaining comparable performance levels to or even obtaining better performance levels than the artificial grass mats according to the prior art. A further object of the invention is to simplify the work surrounding the weaving device to which the method is applied and to obtain a weaving device which operates more quietly and fewer downtimes during weaving.

The object of the invention is achieved by providing an artificial grass mat comprising a ground fabric and a number of artificial grass blades protruding from the ground fabric, at least one of the artificial grass blades being formed from a pile-warp yarn having a density of less than 5,000 dtex and the artificial grass blades being distributed over the aforementioned grass mat in the form of rows, spread over the weft direction, of artificial grass burls which succeed one another in the warp direction, the artificial grass blades protruding from the ground fabric forming pile legs of the artificial grass burls which are bound in the ground fabric over opposing weft yarns in a W bond.

In a preferred embodiment at least one of the artificial grass blades is formed from a pile-warp yarn having a density of less than or equal to 4,000 dtex, more particularly less than or equal to 3,000 dtex and most particularly less than or equal to 2,000 dtex. It will be clear that all artificial grass blades in the fabric according to the invention can have a density of less than 5,000 dtex or less than one of the other aforementioned densities.

According to a preferred embodiment of the artificial grass mat according to the present invention, the aforementioned artificial grass mat comprises at least 20,000 artificial grass burls per $m^2$. Preferably the artificial grass mat comprises at least 30,000 artificial grass burls, more particularly the artificial grass mat comprises at least 40,000 artificial grass burls and in a most particular embodiment the artificial grass mat comprises at least 50,000 artificial grass burls per $m^2$.

In the artificial grass mat according to the invention, each artificial grass burl comprises preferably two pile legs, each artificial grass burl between its two upright legs being bound at least three times over weft yarns in between of them. This has the advantage that each pile leg is bound around different wefts, both of which are located between the two upright pile legs. In particular each artificial grass burl between its two upright legs is bound five times over well yarns in between. More particularly each artificial grass burl between its two upright legs is bound seven times over well yarns in between.

In a most preferred embodiment of the artificial grass mat according to the invention the distance between two pile legs, which succeed each other in the warp direction, of a different pile-warp yarn is less than the distance between two pile legs, which succeed each other in the warp direction, of a single artificial grass burl.

According to a particularly advantageous embodiment of the artificial grass mat according to the invention at least one of the artificial grass blades protruding from the ground fabric is a monofilament yarn, meaning not a bundle of a plurality of filaments or yarns. According to a more particular embodiment of the artificial grass mat in addition to the artificial grass blades protruding from the ground fabric, at least one shrinkably textured yarn also protrudes from the ground fabric. Textured yarns of this type are made of polyethylene or polyamide and shrink after cutting-through and/or heating and thus act as a filling yarn in the artificial grass mat. These filling yarns support, on the one hand, the cut pile and have, on the other hand, the function of maintaining any filling of the artificial grass mat and preventing excessive compaction of this filling. Furthermore a filling yarn of this type can contribute to the damping of a ball strike or to the replacement of conventional fillings in artificial grass.

According to a most particular embodiment of the artificial grass mat according to the present invention the aforementioned grass mat is woven using a double-face weaving method.

Another subject-matter of the present invention relates to a method for the production of an artificial grass mat comprising a ground fabric and a number of artificial grass blades protruding from the ground fabric. According to the invention a bottom and a top fabric are woven using a double-face weaving method, the fabrics consisting of weft yarns, ground-warp yarns and grass blade-forming pile-warp yarns, thus forming alternately in both fabrics artificial grass burls each having two pile legs, at least one of the grass blade-forming pile-warp yarns having a density of less than 5,000 dtex and the grass blade-forming pile-warp yarns being interlaced over the weft yarns according to a W weave structure.

According to a particular method for the production of an artificial grass mat the grass blade-forming pile-warp yarns in the weft direction are distributed over a number of pile-warp systems, each pile-warp system comprising a number of grass blade-forming pile-warp yarns which are interlaced according to a W weave structure and the various aforementioned pile-warp yarns within a single pile-warp system being offset with respect to one another in the warp direction. This has the advantage that the pile legs of the artificial grass burls formed are much more spread over the artificial grass mat.

According to a more particular method according to the invention in at least one pile-warp system each weft yarn which is located with respect to a tight warp yarn on the back of the artificial grass mat is bound by at least two grass blade-forming pile-warp yarns, each of these two pile-warp yarns placing one pile leg each on a different side of the weft yarn.

According to a most particular method according to the invention there extend in each pile-warp system six grass blade-forming pile-warp yarns which are interlaced according to a 5/12 W weave-structure and which within a single pile-warp system are each offset over the two picks respect to one another.

In another preferred method according to the invention there extend in each pile-warp system six grass blade-forming pile-warp yarns which are interlaced according to a 7/16 W bond and which within a single pile-warp system are each offset over four picks with respect to one another.

According to a particularly preferred method according to the invention weaving is carried out in phase opposition, so in the shed formation for each rising pile-warp yarn a different pile-warp yarn at the same time falls over the same distance.

In order further to illustrate the features of the present invention and in order to indicate additional advantages and particularities thereof, there will now be described in greater detail an artificial grass mat according to the invention and the method for the forming of a grass mat of this type. It will be clear that nothing in the following description may be interpreted as a limitation of the protection for the invention sought in the claims.

BRIEF DESCRIPTION OF THE DRAWINGS

In the present description reference numerals will be used to refer to the appended drawings, in which.

DETAILED DESCRIPTION OF THE PREFERRED EMBODIMENTS

The artificial grass mat according to the invention comprises a ground fabric and a number of artificial grass blades protruding from the ground fabric. The ground fabric consists of tight warp (21) and binding warp yarns and weft yarns. The artificial grass mat is woven using a double-face weaving method forming a double-face fabric comprising a bottom and a top ground fabric. Both fabrics consist of weft yarns, ground-warp yarns and grass blade-forming pile-warp yarns which are interlaced alternately in the top and bottom fabric over the weft yarns in between by a W bond. The grass blade-forming pile-warp yarns are distributed over various pile-warp systems which are distributed over the weft direction of the weaving machine. A pile-warp system consists of a number of pile-warp yarns which form the artificial grass burls in one row in the warp direction. Usually, the number of pile-warp yarns in one pile-warp run corresponds to the number of pile-warp yarns within one reed dent without every reed dent necessarily being occupied by a pile-warp system. The plastics material grass blade-forming pile-warp yarns are cut through between both ground fabrics by means of a known cutting device, thus providing two ground fabrics which each form an artificial grass mat with artificial grass burls which succeed one another in the warp direction and are formed from the grass blade-forming pile-warp yarns. The artificial grass mat according to the invention comprises at least 20,000 proportionally distributed artificial grass burls per $m^2$ but can also contain more than 25,000, more than 30,000 or more than 40,000 per $m^2$.

The pile-warp yarns from which the artificial grass blades are formed have a density of less than 5,000 dtex.

Each artificial grass burl comprises two pile legs, wherein for each burl the plastics material grass blade between its two upright legs is interlaced at least three times over weft yarns in between. As a result each pile leg is interlaced around a different weft, both of which are located between the two pile legs. Furthermore the plastics material grass blade portion which joins the two pile legs together in the ground fabric is interlaced over at least one additional weft between the two pile legs. Applying one additional weft the weave structure is called ⅜ W.

As will be apparent from the following, each artificial grass burl between its two upright legs can likewise be interlaced at least five times, and more particularly at least seven times over weft yarns in between.

Figure 1:
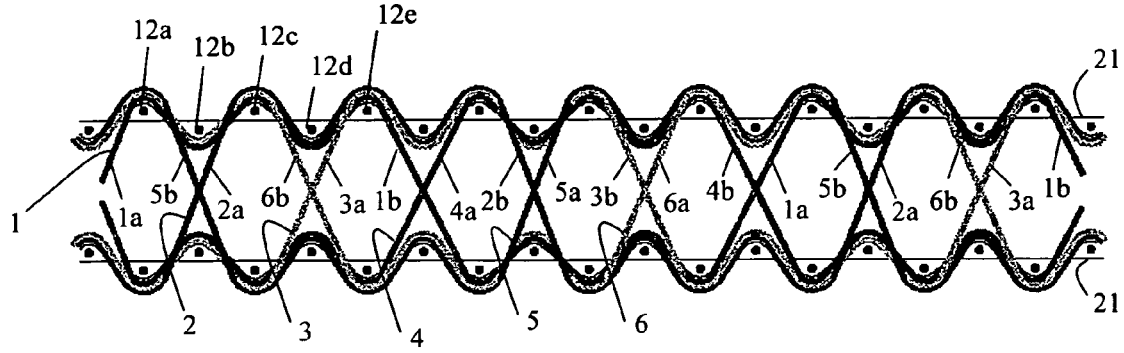
FIGS. 1, 2 and 3 are schematic cross sections in the warp direction of a portion of a double-face fabric from which the artificial grass mats according to the invention are formed.

The pile-warp yarns (1-6) can be interlaced, as presented in FIG. 1, according to a 5/12 W weave structure; in this case each artificial grass burl between opposing weft yarns (12*a*-12*e*) in between. Thus, the artificial grass burl formed (after cutting of the upper and lower fabric) from the pile-warp yarn denoted by reference numeral 1 comprises two pile legs 1*a* and 1*b*, and five wefts (12*a*-*e*) lie between these two pile legs. When the pile-warp yarns (7-10), (15-18) are interlaced, as presented in FIGS. 2 and 3, according to a 7/16 W weave structure, each artificial grass burl between its two upright legs (7*a*-10*a*;7*b*-10*b*), (15*a*-18*a*;15*b*-18*b*) is interlaced seven times over weft yarns (13*a*-13*g*), (14*a*-14*g*) in between. Thus, the artificial grass burl formed (after cutting of the upper and lower fabric) from the pile-warp yarn denoted by reference numeral 7 comprises two pile legs 7*a* and 7*b*, and 7 wefts (13*a*-*g*) lie between these two pile legs: three (13*b, d* and *f*) on the pile side of the tight warp yarn and four (13*a, c, e* and *g*) on the back of the tight warp yarn.

The distance between two successive pile legs (1*a*, 5*b*) of a different pile-warp yarn is preferably less than the distance between two successive pile legs of a single artificial grass burl (1*a*-*b*, 2*a*-*b*, 3*a*-*b*,4*a*-*b*,5*a*-*b*,6*a*-*b*).

Thus, FIG. 1 shows for example a grass mat formed from a fabric, the grass blade-forming pile-warp yarns also being interlaced according to a 5/12 W weave structure, 6 single monofilaments 1×2,000 dtex (1-6) per pile-warp system being used in an offset of two picks (12*a*-*e*) per pile-warp yarn system. An artificial grass mat of this type has, in each weft on the back (12*a*,12*c*,12*e*) of the fabric with respect to the tight warp-yarn (21) on both sides, an upright pile leg (1*a*,2*a*,3*a*, 4*a*,5*a*,6*a* 1*b*,2*b*,3*b*,4*b*,5*b*,6*b*) (albeit not of the same artificial grass burl).

This has the advantage that the pile legs are very well spread over the fabric. The number of pile legs corresponds to that of a ½V weave structure, although the grass burls are in this case interlaced much more sturdily by the 5/12 W weave structure. The pile yarn in the 5/12 W weave structure is interlaced over 5 wefts (12*a*-*e*) whereas in the ½V weave structure it is interlaced merely over 1 weft. There are as many single filaments on the ground fabric, as is known in the prior art, where pile-warp yarns 6×2,000 dtex are interlaced according to a 5/12 W weave structure with 1 pile-warp yarn per pile-warp system, but according to the invention spread of the filaments, artificial grass blades, is better.

As a result of the better spread of the grass burls the artificial grass mat has a denser appearance and the play properties thereon are better than those according to the prior art.

Additional elements which benefit the efficiency of the method include:

- the yarns in the weaving creel have a limited density, and this greatly simplifies the knotting of the pile-warp yarn with respect to the knotting of bundled monofilaments which are extremely difficult to knot. This yields a considerable saving in man-hours;
- the formed knots are smaller, as a result of which they cause fewer problems when they extend through the jacquard headles in the weaving machine; furthermore the presence thereof is less disruptive in the fabrics which are formed. In the event of the yarn pile becoming stuck the pile yarn will, as a result of its lower density, break more rapidly; in other words the pile yarn will break at a lower load, as a result of which the machine components or harness components will not first undergo deformation before the yarn breaks;

the weaving creel consists of a much larger number of bobbins comprising single monofilament yarns, thus providing a much larger supply of yarn in the machine and allowing the machine to continue operating autonomously for longer, without the intervention of bobbin setters;

the jacquard device operates more quietly because weaving is carried out in phase opposition, so on each pick one pile-warp yarn rises and one pile-warp yarn falls over the same distance. Of the remaining 4 pile-warp yarns per pile-warp run, there move 2 on and below the wefts in the top fabric and at the same time 2 other pile-warp yarns down and up in the bottom fabric. The movement of the pile-warp yarns run symmetrically, and this requires less energy for the driving of the jacquard;

the cost of the pile yarn is lower than in the prior art because the twisting of 8 filaments to form one filament entails considerable cost (0.5 €/kg).

The artificial grass mats which are formed are better in terms of play properties (for example ball roll) and in terms of appearance for the same amount of pile. Reducing the amount of pile also allows comparable results and appearance to be obtained with less pile material. The amount of pile can be reduced both by reducing the density of the pile legs per $m^2$ and by reducing the number of artificial grass burls per $m^2$.

Thus, in the same configuration from FIG. 1, 6 individually controlled monofilaments which are offset in the warp direction of, for example, 1,600 dtex, 1,400 dtex or 1,200 dtex per warp system can be used. This reduces the amount of pile yarn consumed, and this significantly reduces the cost of the artificial grass mat. Obviously, a similar method can be used with 8 single monofilaments (1×2,000, 1×1,400 or 1×1,200 dtex or other densities) in a 7/16 W weave structure with the same advantages and effects.

In the presented fabric structures one or more of the single monofilament yarns can also be replaced by a textured yarn made of polyethylene or polyamides which, after cutting-through and/or heating, shrinks and acts as a filling yarn in the artificial grass mat. Such filling yarn supports, on the one hand, the cut pile. On the other hand, such filling yarn also has a function to secure any sand or rubber filling and to prevent it from undergoing compaction. Furthermore such filling yarn can contribute to the damping of a ball strike or to the replacement of conventional fillings in artificial grass. Such filling yarn can also be added, as additional pile-warp yarn per pile-warp system or in a part of the pile-warp systems, to the embodiments and fabric structures as described within the present patent application.

Another variation consists in combining two monofilaments (from the same bobbin and through the same jacquard headle), wherein these monofilaments may or may not be twisted.

Figure 2:
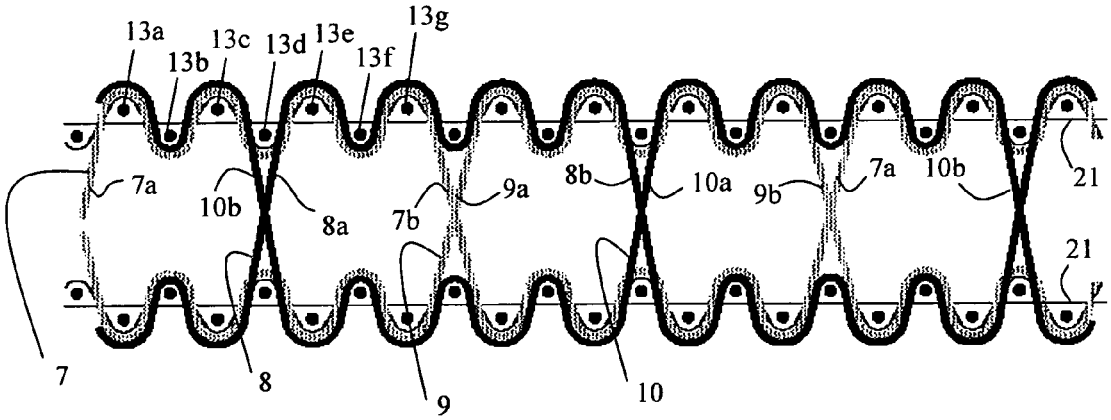
Figure 3:
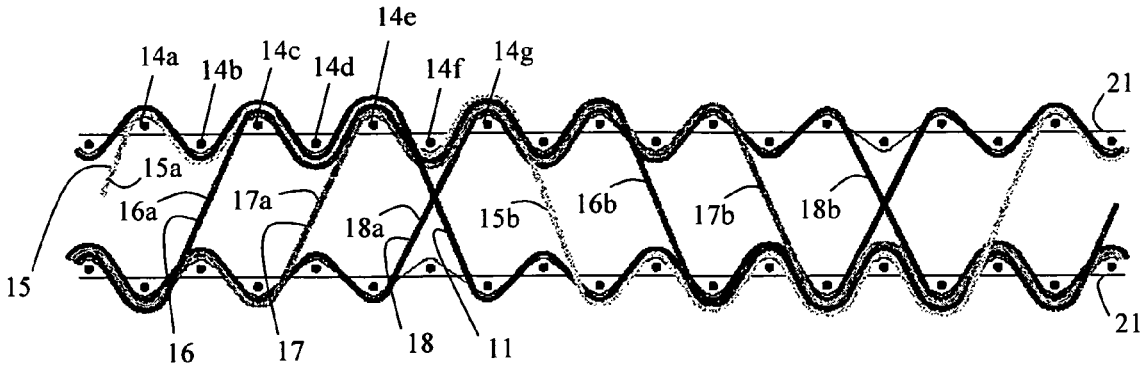

FIG. 2 is an embodiment including 4 bundled filaments 2×2,000 dtex (the filaments 2,000 dtex are wound in pairs on a bobbin and move in pairs through a jacquard headle). The 4 bundled filaments (7,8,9,10) are interlaced according to a 7/16 W bond and are within a single pile-warp system offset over in each case 4 picks. An embodiment of this type has a somewhat lower pile distribution than the above-described embodiment according to the invention, because the weft is interlaced by 2 pile legs merely around the 2 wefts on the back of the fabric with respect to the tight warp-yarn (21). However, the pile distribution remains significantly better than the distribution known in the prior art. Such double filaments can still easily be knotted at all times and the knots also lead to less disruption in the weaving process. Obviously, filaments having other densities, such as for example 1,200 dtex, 1,400 dtex, 1,600 dtex, etc., are also possible in this case.

Use may also be made of 4 pile yarns which are made of monofilaments comprising merely yarn having a density of greater than 2,000 dtex, such as for example 2,400 dtex, 2,800 dtex, 3,000 dtex or 3,600 dtex.

Obviously, the 5/12 W weave structure or other W weave structures can also be used for this purpose and, in this case too, a textured polyethylene or polyamide yarn can be used in addition to or to replace one of the monofilaments.

A number of other embodiments according to the invention are also possible. Presented in FIG. 3 by way of example is a still further embodiment using 4 grass blade-forming pile yarns (15,16,17,18) as single or double monofilament in a 7/16 W weave structure having an offset of two picks between each of the 4 aforementioned pile yarns. A fifth monofilament yarn (11) is additionally used in the same offset, this fifth monofilament yarn being a textured yarn which, after cutting-through, shrinks and acts as a filling yarn.

In this embodiment one pile leg of artificial grass pile is interlaced per weft (14*a*;14*c*,14*e*;14*g*) to the back of the fabric and a filling yarn (11) moves between this artificial grass pile. This is a preferred possibility to spread the pile yarns more in the fabric.

The artificial grass mat according to the invention is suitable both for deployment in the practising of sport, such as for example football, tennis, hockey, golf and the like, and for deployment for other uses, such as for example domestic and garden applications, as a decorative landscape element.

The invention claimed is:

1. Artificial grass mat comprising a ground fabric and a number of artificial grass blades protruding from the ground fabric, wherein at least one of the artificial grass blades is formed from a pile-warp yarn having a density of less than 5,000 dtex and in that the artificial grass blades are distributed over the weft direction, of artificial grass burls which succeed one another in the warp direction, the artificial grass blades protruding from the ground fabric forming pile legs of the artificial grass buds which are interlaced in the ground fabric over weft yarns in between according to a W weave structure, wherein each artificial grass burl comprises two pile legs, each artificial grass burl between upright legs being interlaced at least three times over weft yarns in between.

2. Artificial grass mat according to claim 1, wherein the aforementioned artificial grass mat comprises at least 20,000 artificial grass burls per $m^2$.

3. Artificial grass mat according to claim 1, wherein each artificial grass burl between its two upright legs is interlaced five times over weft yarns in between.

4. Artificial grass mat according to claim 1, wherein each artificial grass burl between its two upright legs is interlaced seven times over weft yarns in between.

5. Artificial grass mat according to claim 1, wherein the distance between two pile legs, which succeed each other in the warp direction, of a different pile-warp yarn is less than the distance between the two pile legs, which succeed each other in the warp direction, of a single artificial grass burl.

6. Artificial grass mat according to claim 1, wherein at least one of the artificial grass blades protruding from the ground fabric is a monofilament yarn.

7. Artificial grass mat according to claim 1, wherein in addition to the artificial grass blades protruding from the ground fabric, at least one shrinkably textured yarn also protrudes from the ground fabric.

8. Artificial grass mat according to claim 1, wherein the aforementioned grass mat is woven using a double-face weaving method.

9. Method for the production of an artificial grass mat comprising, providing a ground fabric and a number of artificial grass blades protruding from the ground fabric, weaving a bottom and a top fabric using a double-face method, the fabrics consisting of weft yarns, ground-warp yarns, and grass blade-forming pile-warp yarns, forming alternately in both fabrics artificial grass burls each having two pile legs, wherein at least one of the grass blade-forming pile-warp yarns has a density of less than 5,000 dtex and in that the grass blade-forming pile-warp yarns are interlaced over the weft yarns according to a W weave structure, wherein each artificial grass burl comprises two pile legs, each artificial grass burl between upright legs being interlaced at least three times over weft yarns in between.

10. Method according to claim 9, wherein the grass blade-forming pile-warp yarns are distributed over a number of pile-warp systems, each pile-warp system comprising a number of grass blade-forming pile-warp yarns which are interlaced according to a W weave structure and the various aforementioned pile-warp yarns within a single pile-warp system being offset with respect to one another in the warp direction.

11. Method according to claim 9, wherein at least one pile-warp system each weft yarn which is located with respect to a tight warp yarn on the back of the artificial grass mat is interlaced by at least two grass blade-forming pile-warp yarns, each of these two pile-warp yarns placing one pile leg each on a different side of the weft yarn.

12. Method according to claim 9, wherein there extend in each pile-warp system six grass blade-forming pile-warp yarns which are interlaced over the weft yarns according to a $^{5}/_{12}$ W weave structure and with respect to one another.

13. Method according to claim 9, wherein there extend in each pile-warp system six grass blade-forming pile-warp yarns which are interlaced over the weft yarns according to a $^{7}/_{16}$ W weave structure and which within a single pile-warp system are each offset over four picks with respect to one another.

14. Method according to claim 9, wherein weaving is carried out in phase operation, so in the shed formation for each rising pile-warp yarn a different pile-warp yarn at the same time falls over the same distance.

* * * * *